US007758440B2

(12) United States Patent
Llewellyn et al.

(10) Patent No.: US 7,758,440 B2
(45) **Date of Patent: *Jul. 20, 2010**

(54) WOOD-TYPE GOLF CLUB HEADS AND METHODS OF ADJUSTING THE SAME

(75) Inventors: David Llewellyn, Duluth, GA (US); Chuck Couch, Cumming, GA (US)

(73) Assignee: Mizuno USA, Inc., Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/038,632

(22) Filed: Feb. 27, 2008

(65) Prior Publication Data

US 2009/0048037 A1 Feb. 19, 2009

Related U.S. Application Data

(63) Continuation-in-part of application No. 29/283,553, filed on Aug. 16, 2007, now Pat. No. Des. 579,507.

(51) Int. Cl.
*A63B 69/36* (2006.01)
*A63B 53/04* (2006.01)

(52) U.S. Cl. ..... 473/244; 473/324; 473/345; 473/409

(58) Field of Classification Search ..... 473/324–350, 473/244–248, 409; D21/733, 752, 759
See application file for complete search history.

(56) References Cited

U.S. PATENT DOCUMENTS 3,965,714 A * 6/1976 Beard ..... 72/31.02
4,431,192 A * 2/1984 Stuff, Jr. ..... 473/327
4,869,507 A * 9/1989 Sahm ..... 473/337
5,221,086 A * 6/1993 Antonious ..... 473/327
D418,885 S 1/2000 Wanchena
D438,583 S 3/2001 O'Doherty et al.
D457,212 S 5/2002 Yamane et al.
D484,937 S * 1/2004 Madore et al. ..... D21/759
7,062,829 B2 * 6/2006 Perez ..... 29/281.5
D526,372 S 8/2006 Kohno
D532,470 S 11/2006 Oldknow
D534,599 S 1/2007 Barez et al.
7,156,750 B2 * 1/2007 Nishitani et al. ..... 473/329
D536,401 S 2/2007 Kawami
D541,895 S 5/2007 Barez et al.
D543,600 S 5/2007 Oldknow
D554,720 S 11/2007 Barez et al.
D571,884 S 6/2008 Oldknow et al.
D579,507 S * 10/2008 Llewellyn et al. ..... D21/759
2007/0022799 A1 * 2/2007 Latiri ..... 72/316

* cited by examiner

*Primary Examiner*—Sebastiano Passaniti
(74) *Attorney, Agent, or Firm*—Troutman Sanders LLP; Trenton A. Ward; Robert R. Elliott, Jr.

(57) ABSTRACT

The present invention describes wood-type golf club heads and methods of adjusting these wood-type golf club heads. An exemplary embodiment of the present invention provides a wood-type golf club head having a body with a sole portion, a face portion, and a hollow interior. Furthermore, a crown portion is disposed on the body, and the crown portion has an upper crown and a lower crown. The upper crown is disposed a predetermined height above the lower crown and the lower crown makes up more than half of the crown portion.

12 Claims, 3 Drawing Sheets

WOOD-TYPE GOLF CLUB HEADS AND METHODS OF ADJUSTING THE SAME

BENEFIT CLAIMS TO PRIOR APPLICATIONS

This Application is a continuation-in-part of U.S. Design patent application Ser. No. 29/283,553, filed 16 Aug. 2007, the entire contents and substance of which are hereby incorporated by reference as if fully set forth below.

FIELD OF THE INVENTION

This invention relates generally to the field of wood-type golf club heads, and specifically to systems and methods to provide a wood-type golf club head enabled to be efficiently and effectively adapted for desired golf ball trajectory.

BACKGROUND OF THE INVENTION

Purchasing a new set of golf clubs is a major investment for many golfers. Therefore, any golfer who is about to invest in purchasing a new set of clubs typically takes the extra step to insure that their new golf clubs are custom fit rather than purchasing "off-the shelf golf clubs." "Off-the-shelf" golf clubs are one-size-fits-all, designed for a "typical" golfer. Normally an "average golfer" refers to someone who is approximately 5-foot-9 or 5-10 and hits a 5- or 6-iron about 160 yards. However, every golfer has a different body shape, and a different golf swing. A golfer might get lucky with an off-the-shelf set, but many golfers will find that such a set is ill-suited for their particular body and/or swing. As a result many golfers are opting for custom fitting session to insure that they are receiving the greatest payback for their new investment.

A typical club fitting session begins with a static fitting. That is, various measurements of the golfer, such as the golfer's height, the distance between the golfer's fingertip and floor, the golfer's hand size, and the like are measured and recorded. Using these measurements, the club fitter can determine a set of specifications for a custom fit golf club, as a starting point. Once the static fitting is complete, the club fitting session moves to a dynamic fitting, in which the golfer hits numerous balls so that the ball flight can be observed and the specifications of the custom-fit golf club can be refined. Typically, the golfer will hit many variations of the same club. For instance, a well-equipped fitting center might have dozens of a particular club, say a 6-iron. Each of the 6-irons will be different from the next in some way, such as lie angle, shaft flex, shaft length, and the like. The main purpose is to find the best combination of shaft, lie, grip, and swing weight that produces the best ball flight for that particular golfer.

During the dynamic fitting process, one specification that is checked and refined is the lie angle of the golf club. To determine the proper lie angle, the golfer is asked to hit several balls of a hard surface, such as a lie board. By making contact with the lie board, an impact mark will be left on the sole of the golf club, which helps determine the proper lie angle. For example, if the impact mark is near the center of the sole as measured from the heel to the toe, the lie angle is correct for that particular golfer. However, if the impact mark is toward the toe of the golf club, this indicates that the lie angle is too flat for the particular golfer. Similarly, if the impact mark is toward the heel of the golf club, the lie angle is too upright for the particular golfer. By observing where the impact marks on the sole of the golf club occur, the club fitter can determine the optimal lie angle of the golf club for that golfer.

However, determining the proper lie angle required that the club fitter make an intelligent guess as to how far the impact mark was from the center of the sole of the golf club and therefore the approximate lie angle. Once the approximate lie angle is determined, the golfer must hit several more balls with a golf club with a modified lie angle. This process is repeated until the proper lie angle is determined. To reduce the "guesswork" of the club fitter for selecting the proper lie angle, trial golf clubs used for club fitting may contain graduated markings along the sole that run perpendicular to the face of the golf club. Each graduated marking corresponds to a particular incremental change in the lie angle referenced from the center of the sole. Therefore, the club fitter can easily tell the proper lie angle for a particular golfer by observing at which graduated mark the impact mark appears, thereby eliminating any guesswork from determining the proper lie angle.

Another specification that is refined during the dynamic club fitting session is the loft angle of the golf club. Normally, this characteristic is determined using subjective criteria. In a typically club fitting session, the golfer will hit several shots with a golf club having a known loft angle. The club fitter observes the flight path of the golf ball and determines whether in his or her judgment, the flight of the ball is too high or too low. If the club fitter believes that the ball flight is too high, he or she will have the golfer hit several more shots with a golf club that has a stronger (less) loft. Conversely, if the club fitter believes that the ball flight is too low, he or she will have the golfer hit several more shots with a golf club that has a weaker (more) loft. This process continues until, in the view of the club fitter, that the golfer has achieved the proper ball flight.

After a club fitter has gathered the necessary data regarding the lie angle and loft angle necessary for the different clubs of a particular golfer, it is often desired to custom modify one or more of a golfer's clubs to provide the desired loft angle and lie angle for a particular club. Conventional devices are available to the professional club fitter that enable the club fitter to individually adjust the lie angle and/or loft angle for certain types of golf clubs. For example, U.S. Pat. No. 6,871,414 to Burner et al. ("'414 Patent") discloses an apparatus for measuring and adjusting golf club loft and lie. The apparatus is a large mechanical structure that includes a clamping assembly to hold a golf club, two infrared shaft cameras to provide a stereoscopic view of the club shaft, stall sensors, constraint blocks, a clamp inclinometer and a structure inclinometer to measure orientation relative to gravity, and a computer system including a monitor to provide a graphical user interface. The '414 Patent discloses that the apparatus can be used by a professional technician to measure the lie and loft angles of a particular golf club and implement a bending force on the clamping assembly to adjust the lie and loft angles of the club.

U.S. Pat. No. 5,421,098 to Muldoon ("'098 Patent") discloses a machine for adjusting loft and lie angles of a golf club head. The apparatus disclosed in the '098 Patent provides three components: (1) a fitting gauge attachable to a golf shaft to identify the lie angle and loft angle for a golf club, (2) a bench with components for attaching a golf club head, and (3) an adjusting tool fixed to the bench that enables the shaft of the club to be manipulated relative to the golf club head. The bench assembly of the '098 Patent apparatus provides a loft gauge and a lie gauge that indicate to a technician using the apparatus the current angles of the golf club head. Therefore, the technician can manipulate the adjusting tool until the desired loft and lie angles are achieved.

U.S. Patent Publication No. 2007/022799 to Latiri ("'799 Publication) describes a golf club hosel bending fixture. The bending fixture of the '799 Publication provides an angularly articulating crown jaw assembly, a relatively fixed lower jaw assembly generally opposite the crown jaw, a longitudinally disposed back jaw assembly, and a club head face jaw disposed at the base of the crown jaw track. The four jaw assemblies serve to clamp a golf club head securely in place. Thereby the golf club head can be manipulated by the articulating assemblies to adjust the lie angle and loft angle of the golf club head.

Despite working for their intended purposes, these conventional golf club head bending machines are unable to accurately and effectively modify wood-type golf club heads. More particularly, if the conventional iron golf club head bending machine described in the '799 Publication is used to adjust the lie or loft angle of a wood-type golf club head, the club head with be damaged and/or the performance of the club head will be degraded. Therefore, there is a continuing need for a wood-type golf club head enabled to be adjusted by a conventional iron golf club head bending machine. Furthermore, there is a need for a wood-type golf club head with improved playing performance that is enabled to be adjusted by a conventional iron golf club head bending machine.

BRIEF SUMMARY OF THE INVENTION

The present invention describes a wood-type golf club head and methods of adjusting these wood-type golf club heads. An exemplary embodiment of the present invention provides a wood-type golf club head having a body with a sole portion, a face portion, and a hollow interior. Furthermore, a crown portion is disposed on the body, and the crown portion has an upper crown and a lower crown. The upper crown is disposed a predetermined height above the lower crown and the lower crown makes up more than half of the crown portion. In some embodiments, the upper crown and the face portion can comprise a first material and the lower crown can comprise a second material.

In addition to a wood-type golf club head, the present invention provides methods of adjusting a wood-type golf club head. An exemplary embodiment of the present invention provides a method of adjusting a wood-type golf club head that includes the step of providing the wood-type golf club head with a crown portion comprising an upper crown and a lower crown, the upper crown being disposed a predetermined height above the lower crown. Furthermore, the method includes the step of inserting the wood-type golf club head into a conventional iron golf club head bending machine, and the distance of a predetermined height between the upper crown and lower crown enables the wood-type golf club head to be clamped into the bending machine. Additionally, the method includes the step of modifying the loft angle of the wood-type golf club head with the bending machine without damaging the wood-type golf club head.

These and other objects, features and advantages of the present invention will become more apparent upon reading the following specification in conjunction with the accompanying drawing figures.

DETAILED DESCRIPTION OF PREFERRED EMBODIMENTS

The present invention addresses the drawbacks in the prior art with respect to the ineffectiveness of wood-type golf club heads and the difficulties in precisely adjusting the lie and loft angles of such wood-type golf club heads. In accordance with an exemplary embodiment of the present invention, a wood-type golf club head is provided with an optimal crown design to enable more effective shot placement. Furthermore, an exemplary embodiment of the present invention provides a wood-type golf club head, which can easily be modified for loft and lie adjustments with a conventional iron golf club head bending machine.

In an exemplary embodiment, the present invention provides a wood-type golf club head having a body with a sole portion, a face portion, and a hollow interior. Furthermore, a crown portion is disposed on the body, and the crown portion has an upper crown and a lower crown. The upper crown is disposed a predetermined height above the lower crown and the lower crown makes up more than half of the crown portion.

Figure 1:
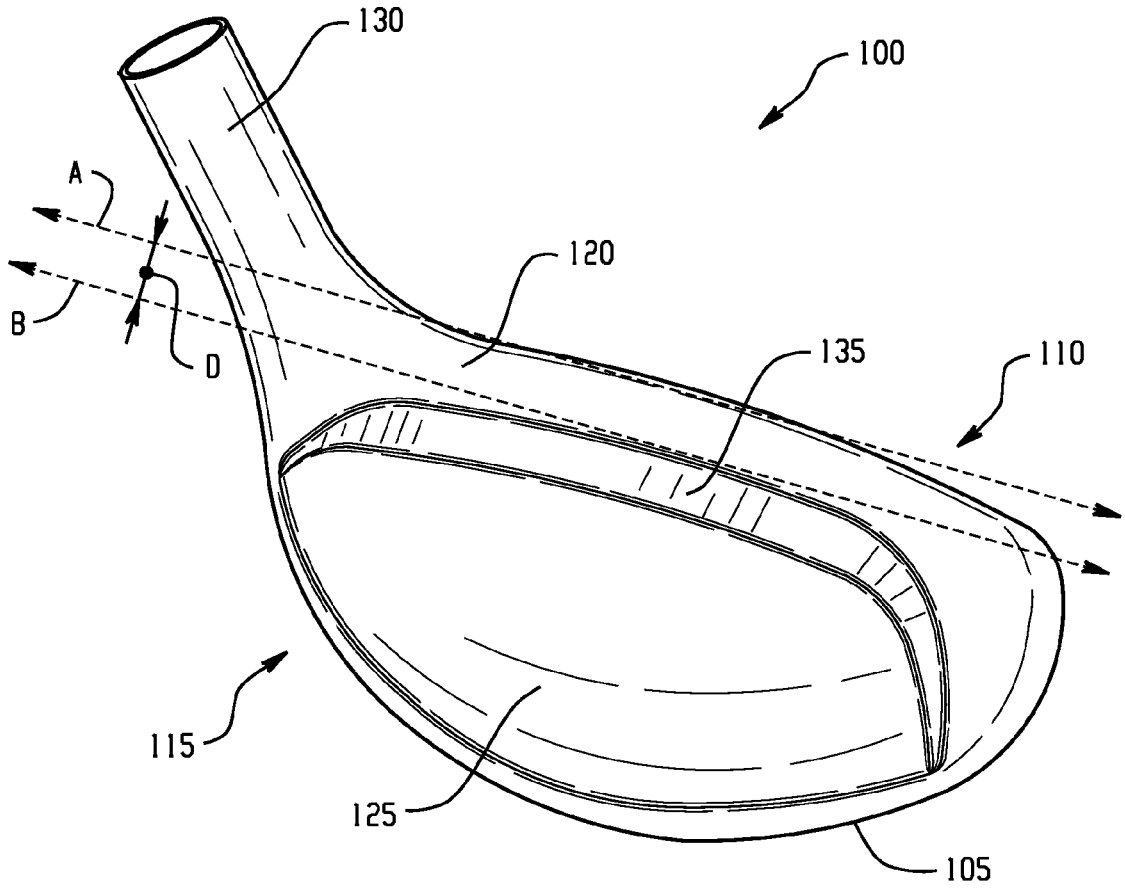
FIG. 1 provides an illustration of a wood-type golf club head 100 in accordance with an exemplary embodiment of the present invention viewed from the rear, non-ball striking surface.

FIG. 1 provides an illustration of a wood-type golf club head 100 in accordance with an exemplary embodiment of the present invention viewed from the rear, non-ball striking surface. As shown in the exemplary embodiment depicted in FIG. 1, the wood-type golf club head 100 provides a sole portion 105, a face portion 110 (not shown), and a crown portion 115. The wood-type golf club head 100 of FIG. 1, as with all figures provided, is not to scale and could be modified according a various embodiments of the present invention. The wood-type golf club head 100 also provides a hosel 130 that enables the wood-type golf club head 100 to be connected to a shaft. Those of skill in the art will appreciate that a variety of different shafts and grips can be pared with the numerous embodiments of the wood-type golf club head 100 in accordance with user preferences.

The crown portion 115 of the exemplary embodiment of the wood-type golf club head 100 shown in FIG. 1 provides both an upper crown 120 and a lower crown 125. In an exemplary embodiment, the upper crown 120 can be disposed a predetermined height above the lower crown 125. In an exemplary embodiment, the drop between the upper crown 120 and lower crown 125 can form a recessed portion 135.

The recessed portion 135 of the wood-type golf club head 100 enables many of the benefits of the present invention. For example, and not limitation, the recessed portion 135 serves to redistribute the weight of the wood-type golf club head 100 and lower the center of gravity of the club head 100. By lowering the center of gravity, the performance of the wood-type golf club head 100 can be improved. Lowering the center of gravity of the wood-type golf club head 100 increases the moment of inertia of the club head 100 and improves the directivity of the hit of a golf ball. Additionally, a deepening of the center of gravity causes an increase in the effective face area of the wood-type golf club head 100. This increase in the effective face area allows the face portion 110 of the wood-type golf club head 100 to be more flexible, thus allowing the wood-type golf club head 100 to be more forgiving in the event of an off-center hit. The ability to provide more forgiveness in the event of an off-center hit is important for wood-type golf club head 100.

In addition to enabling superior performance, the crown portion 115 of the wood-type golf club head 100 can enable the club head 100 to conveniently and effectively adjust the striking angle of the club head 100. The angle of face portion 110 of the wood-type golf club head 100 on contact has a relatively large effect on the flight path of the golf ball. Therefore, it is advantageous to be enabled to precisely adjust the striking angle of the wood-type golf club head 100. More particularly, in an exemplary embodiment it is desired to precisely adjust the loft angle of the wood-type golf club head 100. Those of skill in the art will appreciate that lie loft angle is the angle between the center longitudinal axis of the hosel 130 and the face portion 110. The loft angle "Lo" on the wood-type golf club head 100 has a significant impact on the trajectory of a golf ball struck by the club head 100. For example, and not limitation, a high loft angle "Lo" for a golf club head corresponds to a relatively high golf ball trajectory and a low loft angle "Lo" corresponds to a relatively low golf ball trajectory. Loft angles for wood type golf club can range from around 5 to 30 degrees. Furthermore, in an exemplary embodiment, it is desired to precisely adjust the lie angle of the wood-type golf club head 100. Those of skill in the art will appreciate that the lie angle is the angle between the center longitudinal axis of the hosel 130 and the sole portion 105. The lie angle "Li" on the wood-type golf club head 100 can have a significant impact on the trajectory of a golf ball struck by the club head 100. For example, and not limitation, a large loft angle "Lo" for a golf club head can correspond to a golf ball trajectory to the left of the target, and a small loft angle "Lo" can correspond to a golf ball trajectory to the right of the target.

Prior to the present invention, it was not possible to precisely adjust the loft angle or the lie angle of wood-type golf club head with a conventional iron golf club head bending machine. Therefore, it was exceedingly difficult to precisely adjust the loft angle and lie angle of the wood-type golf club head. For many implementations, it is necessary to adjust the striking angle of the wood-type golf club head in accordance with the type of wood-type golf club head. For example, and not limitation, a five wood golf club head would have a higher loft angle than a three wood golf club head. In other words, the higher the wood-type golf club head 100, the higher the loft angle. Additionally, it is often desired to adjust the lie angle and loft angle of a particular wood-type golf club head 100 in accordance with the demands of an individual golfer. For example, and not limitation, some golfer's may desire a steeper loft angle for a particular wood-type golf club head 100. Additionally, in a non-limiting example, a shorter golfer may desire a greater lie angle than a taller golfer to more properly orient the face portion 110 of the wood-type golf club head 100 on impact. The crown portion 115 of the wood-type golf club head 100 in accordance with an exemplary embodiment of the present invention enables insertion of the club head 100 into a conventional iron golf club head bending machine, such as the one disclosed in U.S. Patent Publication No. 2007/0022799.

In an exemplary embodiment of the wood-type golf club head 100, the upper crown 120 can be disposed between the face portion 110 and the lower crown 125. In an exemplary embodiment, the intersection of the upper crown 120 and the face portion 110 form a Front Edge A, as referenced by the hashed line labeled "A" in FIG. 1. Furthermore, in an exemplary embodiment, the intersection of the upper crown 120 and the recessed portion 135 can form a Rear Edge B, as referenced by the hashed line labeled "B" in FIG. 1. In an exemplary embodiment the Front Edge A and the Rear Edge B can be generally parallel to each other. In an alternative embodiment, the Front Edge A and the Rear Edge B can oriented at an acute angle from each other. Those of skill in the art will appreciate that the orientation of the Front Edge A and Rear Edge B can vary in accordance with the parameters of a particular wood-type golf club head 100 implementation.

In an exemplary embodiment, the distance "D", as shown in FIG. 1, between the Front Edge A and the Rear Edge B, defines the majority of the width of the upper crown 120 along the centerline of the face portion 110. As shown in FIG. 1, the upper crown 120 can be wider than the distance D at the edges of the wood-type golf club head 100. In an alternative embodiment, the upper crown 120 could be a consistent width across the top of the wood-type golf club head 100. The width of the upper crown 120 in an exemplary embodiment can range from 2 mm to 20 mm. In an exemplary embodiment, the upper crown 120 width D is 10 mm. Those of skill in the art will appreciate that the width D can be a variety of different values depending of the parameters of a given implementation.

Figure 2:
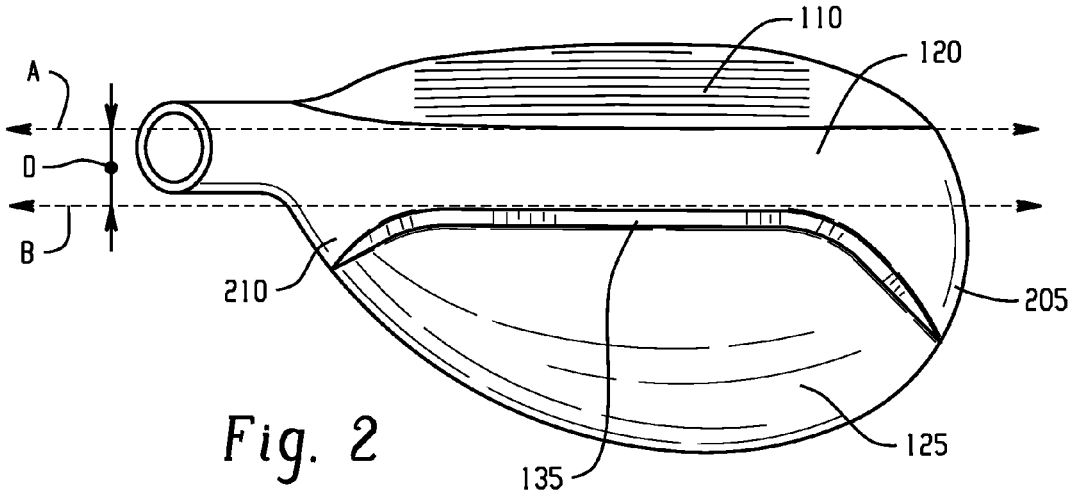
FIG. 2 provides an illustration of a wood-type golf club head 100 in accordance with an exemplary embodiment of the present invention viewed from the top perspective.

FIG. 2 provides an illustration of a wood-type golf club head 100 in accordance with an exemplary embodiment of the present invention viewed from the top perspective. As shown in FIG. 2, the upper crown 120 can have a Front Edge A and a Rear Edge B in an exemplary embodiment. The Front Edge A and Rear Edge B can be generally parallel to each other along the centerline of face portion 110. As shown in FIG. 2, in an exemplary embodiment, the recessed portion 135 between the upper crown 120 and lower crown 125 is defined in the area where the Front Edge A and Rear Edge B are generally parallel. This recessed portion 135 enables some of the significant advantages of the various embodiments of the present invention. Significantly, the recessed portion 135 enables the wood-type golf club head 100 to be altered by a conventional iron golf club head bending machine. More particularly, the wood-type golf club head 100 can be inserted into a conventional golf club head bending machine and the lie angle and loft angle of the club head 100 can be accurately adjusted. Prior art wood type golf club heads are unable to be inserted into a conventional golf club head bending machine without damaging the club and are unable to be accurately adjusted by such a machine.

Additionally, FIG. 2 illustrates the distance D between the Front Edge A and Rear Edge B in an exemplary embodiment of the wood-type golf club head 100. As shown in FIG. 2 the upper crown 120 can widen at the toe portion 205 and the heel portion 210 of an exemplary embodiment of the wood-type golf club head 100. Furthermore, the upper crown 120 can be relatively narrow in an area surrounding the centerline of the face portion 110. In an exemplary embodiment, the centerline of the face portion 110 can vary in distance from 10 mm to 150 mm, and preferably from 25 mm to 100 mm.

Figure 3:
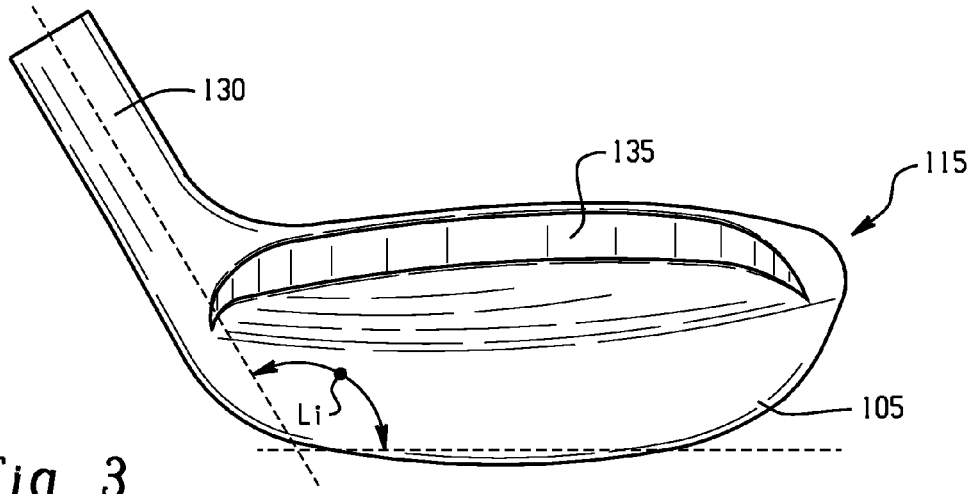
FIG. 3 provides an illustration of a wood-type golf club head 100 in accordance with the present invention viewed from the rear perspective.

FIG. 3 provides an illustration of a wood-type golf club head 100 in accordance with the present invention viewed from the rear perspective. The perspective provided in FIG. 3 provides a good illustration of the recessed portion 135 between an upper crown 120 and a lower crown 125 of an exemplary embodiment of the wood-type golf club head 100. This configuration of the overall crown portion 115 of the wood-type golf club head 100 assists in to redistributing the weight of the wood-type golf club head 100 and lower the center of gravity of the club head 100. This lower center of gravity enables improved performance of the wood-type golf club head 100. Furthermore, the recessed portion 135 permits the accurate adjustment of the loft angle and the lie angle of the wood-type golf club head 100. FIG. 3 provides an illustration of the lie angle "Li" of an wood-type golf club head 100. Those of skill in the art will appreciate that the lie angle "Li" is the angle between the center longitudinal axis of the hosel 130 and the sole portion 105. By inserting the wood-type golf club head 100 into a conventional iron golf club head bending machine, the lie angle "Li" can be adjusted in accordance with the present invention to the precise specifications of the user of the wood-type golf club head 100.

Figure 4:
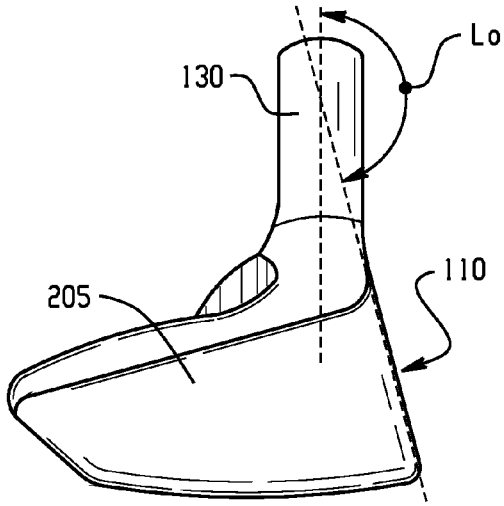
FIG. 4 provides an illustration of a wood-type golf club head 100 in accordance with an exemplary embodiment of the present invention viewed from the toe portion 205 of the wood-type golf club head 100.

FIG. 4 provides an illustration of a wood-type golf club head 100 in accordance with an exemplary embodiment of the present invention viewed from the toe portion 205 of the wood-type golf club head 100. In accordance with an exemplary embodiment of the wood-type golf club head 100, the loft angle "Lo" can be adjusted by a conventional iron golf club head bending machine. As shown in FIG. 4, the loft angle "Lo" is the angle between the center longitudinal axis of the hosel 130 and the face portion 110 of the wood-type golf club head 100. By inserting the wood-type golf club head 100 into a conventional iron golf club head bending machine, the loft angle "Lo" can be adjusted in accordance with the present invention to the precise specifications of the user of the wood-type golf club head 100. Therefore, a golfer can adjust a particular wood-type golf club head 100 to his or her exact demands for that particular golf club head 100.

Figure 5:
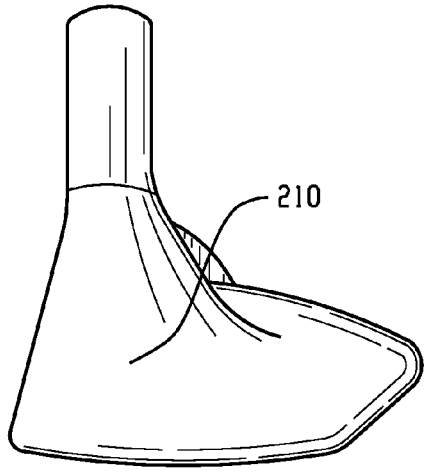
FIG. 5 provides an illustration of a wood-type golf club head 100 in accordance with an exemplary embodiment of the present invention viewed from the heel portion 210 of the wood-type golf club head 100.

FIG. 5 provides an illustration of a wood-type golf club head 100 in accordance with an exemplary embodiment of the present invention viewed from the heel portion 210 of the wood-type golf club head 100. As shown in FIG. 5, the lower crown 125 is provided a distance below the upper crown 120 of an exemplary embodiment of the wood-type golf club head 100.

Figure 6:
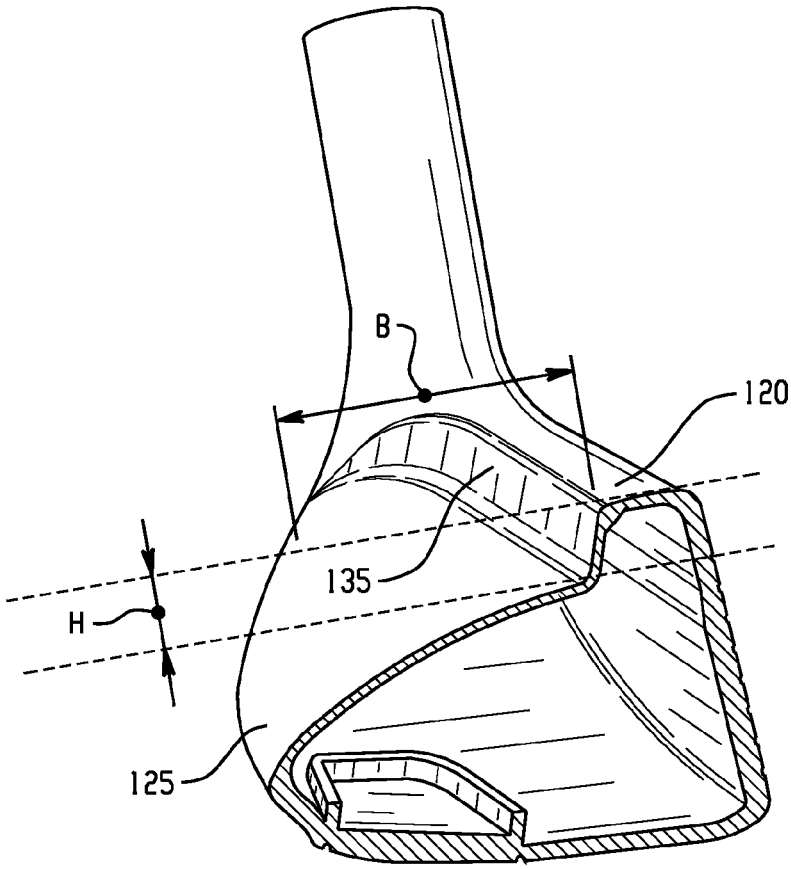
FIG. 6 provides a cross-sectional illustration of a wood-type golf club head 100 in accordance with the present invention viewed from the toe portion 205 of the club head 100.

FIG. 6 provides a cross-sectional illustration of a wood-type golf club head 100 in accordance with the present invention viewed from the toe portion 205 of the club head 100. As shown the upper crown 120 extends reward at a height equivalent to the top of the face portion 110. The lower crown 125, however, extends reward at a height below the level of the upper crown 120. The recessed portion 135 defines the drop between the upper crown 120 and the lower crown 125. The height "H" of the recessed portion 135 is illustrated in the exemplary embodiment shown in FIG. 6. This height "H" can vary according to the particular embodiment of the wood-type golf club head 100. In an exemplary embodiment, the height "H" can be in the range of 3 mm to 30 mm, and preferably 5 mm to 25 mm.

Those of skill in the art will appreciate that the height "H" shown in the exemplary embodiment of the wood-type golf club head 100 in FIG. 6 extends for the entire lower crown 125. Thus, the height "H" is maintained for the entire span of the lower crown 125. In an alternative embodiment, the height "H" extends for only a portion "B" of the lower crown 125. Therefore, in an alternative embodiment, the portion "B" of the lower crown can extend for a distance in the range of 5 mm to 100 mm. In one alternative embodiment the lower crown 125 dips for the distance "B" near the recessed portion 135 of the wood-type golf club head 100 and then extends upward toward the rear of the wood-type golf club head 100.

Figure 7:
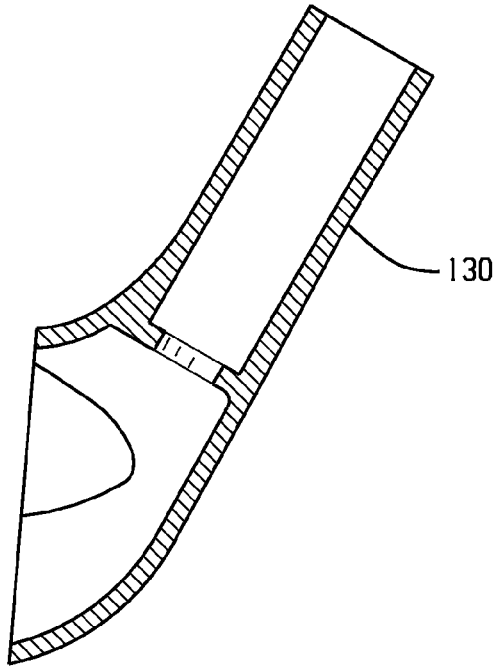
FIG. 7 provides a cross-sectional illustration of a wood-type golf club head 100 in accordance with the present invention viewed from the face portion 110 of the club head 100.

FIG. 7 provides a cross-sectional illustration of a wood-type golf club head 100 in accordance with the present invention viewed from the face portion 110 of the club head 100. FIG. 7 illustrates the manner in which the hosel 130 is connected to the body of the wood-type golf club head 100 in an exemplary embodiment.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A wood-type golf club head comprising:

a body having a sole portion, a face portion, a heel portion, a toe portion, a hosel and a generally hollow interior;

a crown portion disposed on the body, the crown portion comprising an upper crown and a lower crown;

the upper crown including a front edge (A) generally adjacent the face portion and a rear edge (B) spaced rearwardly from the front edge (A) to define a substantially consistent width of between about 2 mm and 20 mm across the top of the club head between the heel portion and the toe portion;

the front edge (A) and the rear edge (B) being generally parallel to each other;

the upper crown being disposed a predetermined height in a range from 3 mm to 30 mm above the lower crown adjacent the rear edge (B) to form a recessed portion;

the recessed portion being defined in the area in which the front edge (A) and rear edge (B) are generally parallel to each other between the heel portion and the toe portion;

the predetermined height being maintained for substantially the entire span of the lower crown;

whereby the width of the upper crown portion and the predetermined height facilitates the application of a clamping force applied to the upper crown and the sole portion to enable adjustment of the loft angle, the lie angle, or both the loft and lie angles of the club head.

2. The wood-type golf club head of claim 1, wherein the predetermined height ranges from 15 mm to 25 mm.

3. The wood-type golf club head of claim 1, wherein the upper crown and the face portion are comprise of a first material.

4. The wood-type golf club head of claim 3, wherein the lower crown comprises a second material.

5. The wood-type golf club head of claim 1, wherein the lower crown is disposed at least the predetermined height below the upper crown for a predetermined distance from the upper crown, the predetermined distance ranging from 5 mm to 100 mm.

6. The wood-type golf club head of claim 1, wherein the predetermined height ranges from 5 mm to 25 mm.

7. A method of adjusting a wood-type golf club head comprising:

providing a body having a sole portion, a face portion, a heel portion, a toe portion, a hosel and a generally hollow interior;

a crown portion disposed on the body, the crown portion comprising an upper crown and a lower crown;

the upper crown including a front edge (A) generally adjacent the face portion and a rear edge (8)s paced rearwardly from the front edge (A) to define a substantially consistent width of between about 2 mm and 20 mm across the top of the club head between the heel portion and the toe portion;

the front edge (A) and rear edge (B) being generally parallel to each other;

the upper crown being disposed a predetermined height in a range from 3 mm to 30 mm above the lower crown adjacent the rear edge (B) to form a recessed portion;

the recessed portion being defined in the area in which the front edge (A) and rear edge (B) are generally parallel to each other between the heel portion and the toe portion;

the predetermined height being maintained for substantially the entire span of the lower crown;

mechanically clamping the wood-type golf club head;

whereby the width of the upper crown portion and the predetermined height facilitates the application of a clamping force applied to the upper crown and the sole portion;

modifying the loft angle, the lie angle or both the loft and lie angles of the club head by bending the wood-type golf club head during the clamping operation.

8. The method of adjusting a wood-type golf club head of claim 7, wherein the predetermined height ranges from 5 mm to 25 mm.

9. The method of adjusting a wood-type golf club head of claim 7, wherein the predetermined height ranges from 15 mm to 25 mm.

10. The method of adjusting a wood-type golf club head of claim 7, wherein the upper crown and the face portion comprise a first material.

11. The method of adjusting a wood-type golf club head of claim 10, wherein the lower crown comprises a second material.

12. The method of adjusting a wood-type golf club head of claim 7, wherein the lower crown is disposed at least the predetermined height below the upper crown for a predetermined distance from the upper crown, the predetermined distance ranging from 5 mm to 100 mm.

* * * * *